US008748721B2

(12) United States Patent
Hirasawa

(10) Patent No.: US 8,748,721 B2
(45) Date of Patent: Jun. 10, 2014

(54) PEDAL DEVICE FOR MUSICAL INSTRUMENT

(71) Applicant: Hoshino Gakki Co., Ltd., Nagoya (JP)

(72) Inventor: Satoshi Hirasawa, Nagoya (JP)

(73) Assignee: Hoshino Gakki Co., Ltd., Nagoya (JP)

( * ) Notice: Subject to any disclaimer, the term of this patent is extended or adjusted under 35 U.S.C. 154(b) by 0 days.

(21) Appl. No.: 13/775,276

(22) Filed: Feb. 25, 2013

(65) Prior Publication Data

US 2014/0090542 A1 Apr. 3, 2014

(30) Foreign Application Priority Data

Sep. 28, 2012 (JP) ..... 2012-215862

(51) Int. Cl.
*G10D 13/02* (2006.01)

(52) U.S. Cl.
USPC ..... 84/422.1

(58) Field of Classification Search
None
See application file for complete search history.

(56) References Cited

U.S. PATENT DOCUMENTS

| | | | | |
|---|---|---|---|---|
| 5,714,701 | A | 2/1998 | Hsieh | |
| 6,172,291 | B1 | 1/2001 | Takegawa | |
| 6,903,257 | B2 | 6/2005 | Yun | |
| 7,579,539 | B2 * | 8/2009 | Chen | 84/422.1 |

FOREIGN PATENT DOCUMENTS

JP 8-123407 A 5/1996

* cited by examiner

*Primary Examiner* — Robert W Horn

(57) ABSTRACT

A cam assembly includes a wheel member fixed to a shaft and a cam member removably attached to the wheel member. By attaching the cam member to the wheel member while arranging the cam member in a first orientation, a first cam shape is given to the cam assembly. Moreover, by attaching the cam member to the wheel member while vertically inverting the cam member to set the cam member in a second orientation, a second cam shape different from the first cam shape is given to the cam assembly.

10 Claims, 8 Drawing Sheets

PEDAL DEVICE FOR MUSICAL INSTRUMENT

BACKGROUND OF THE INVENTION

The present invention relates to a pedal device for a musical instrument such as a bass drum, a high-hat and the like played by stepping on a footboard.

A player plays a bass drum or a high-hat by operating a pedal device by foot. For example, in a pedal device for a bass drum, when a footboard is stepped on by a player, a cam and a shaft are rotated by a chain, and a beater fixed to the shaft hits a batter head of the bass drum. At this time, the shape of the cam largely affects the feeling during the stepping-on operation on the footboard. Thus, some pedal devices have been proposed that are capable of changing the feeling during the stepping-on operation on the footboard in accordance with the preference of the player.

A pedal device disclosed in U.S. Pat. No. 5,714,701 is provided with two split cams and an adjustment screw for adjusting relative positions of the split cams. A threaded hole is formed in each of split surfaces of the split cams, and the adjustment screw is screwed in the threaded hole in each of the split cams. According to the cam structure disclosed in this document, by adjusting the relative positions of the split cams by operating the adjustment screw, the feeling during the stepping-on operation is changed.

A pedal device disclosed in U.S. Pat. No. 6,903,257 is provided with a cam core, a cam member rotationally connected to a lower end of the cam core, and a positioning member. The positioning member is rotationally connected to an upper end of the cam member and is formed to be capable of being engaged with the cam core. According to the cam structure disclosed in this document, a rotation angle of the cam member with respect to the cam core is adjusted by changing engagement positions of the cam core and the positioning member. As a result, the feeling during the stepping-on operation is changed.

A pedal device disclosed in Japanese Laid-Open Patent Publication No. 8-123407 is configured such that a feeling adjusting member is removably attached on an outer peripheral surface of a cam. According to the pedal device disclosed in this document, the feeling during the stepping-on operation is changed by attaching/detaching the feeling adjusting member or by changing the attachment position of the feeling adjusting member.

A pedal device disclosed in U.S. Pat. No. 6,172,291 is provided with a plurality of types of cam members with different cam shapes and is configured such that the plurality of types of cam members can be freely switched and attached to a cam main body. According to the pedal device disclosed in this document, the number of variations in feeling during the stepping-on operation is the same as the number of types of the cams.

However, in the case of U.S. Pat. No. 5,714,701 and U.S. Pat. No. 6,903,257, the configuration for adjusting the relative positions of the split cams and the configuration for changing the rotation angle of the cam member with respect to the cam core are complicated.

On the other hand, in the case of Japanese Laid-Open Patent Publication No. 8-123407 and U.S. Pat. No. 6,172,291, the cam structure is relatively simplified, but a series of operations for changing the attachment position after the feeling adjusting member is attached to the cam or a series of operations for selecting one of the plurality of types of cam members and attaching it to the cam main body are cumbersome and troublesome for users. Moreover, in addition to components constituting the pedal device, the feeling adjusting member or the plurality of types of cam members are needed. Thus, there are problems that storage of components requires labor, components can be lost easily, and the like.

SUMMARY OF THE INVENTION

It is an objective of the present invention to provide a pedal device for a musical instrument that can realize two types of feeling during the stepping-on operation with a simple configuration and can easily switch between the two types of feeling by using one cam.

To achieve the foregoing and in accordance with one aspect of the present invention, a pedal device for a musical instrument is provided. The musical instrument is played by performing a stepping-on operation on a footboard. The device includes a base, a shaft supported rotationally with respect to the base, a cam fixed to the shaft, and a connecting member for connecting the footboard and the cam. The device is configured such that, when the footboard is stepped on, the cam and the shaft are rotated by the connecting member. The cam is composed of a cam assembly provided with a wheel member fixed to the shaft and a cam member removably attached to the wheel member and having a cam surface. By attaching the cam member to the wheel member with the orientation of the cam member set in a first orientation, a first cam shape is given to the cam assembly. By attaching the cam member to the wheel member with the orientation of the cam member set in a second orientation, which is different from the first orientation, a second cam shape, which is different from the first cam shape, is given to the cam assembly.

DETAILED DESCRIPTION OF THE PREFERRED EMBODIMENTS

First Embodiment

A pedal device for a musical instrument according to a first embodiment of the present invention will be described with reference to FIGS. 1 to 6B. In the first embodiment, the pedal device is used for a base drum.

Figure 1:
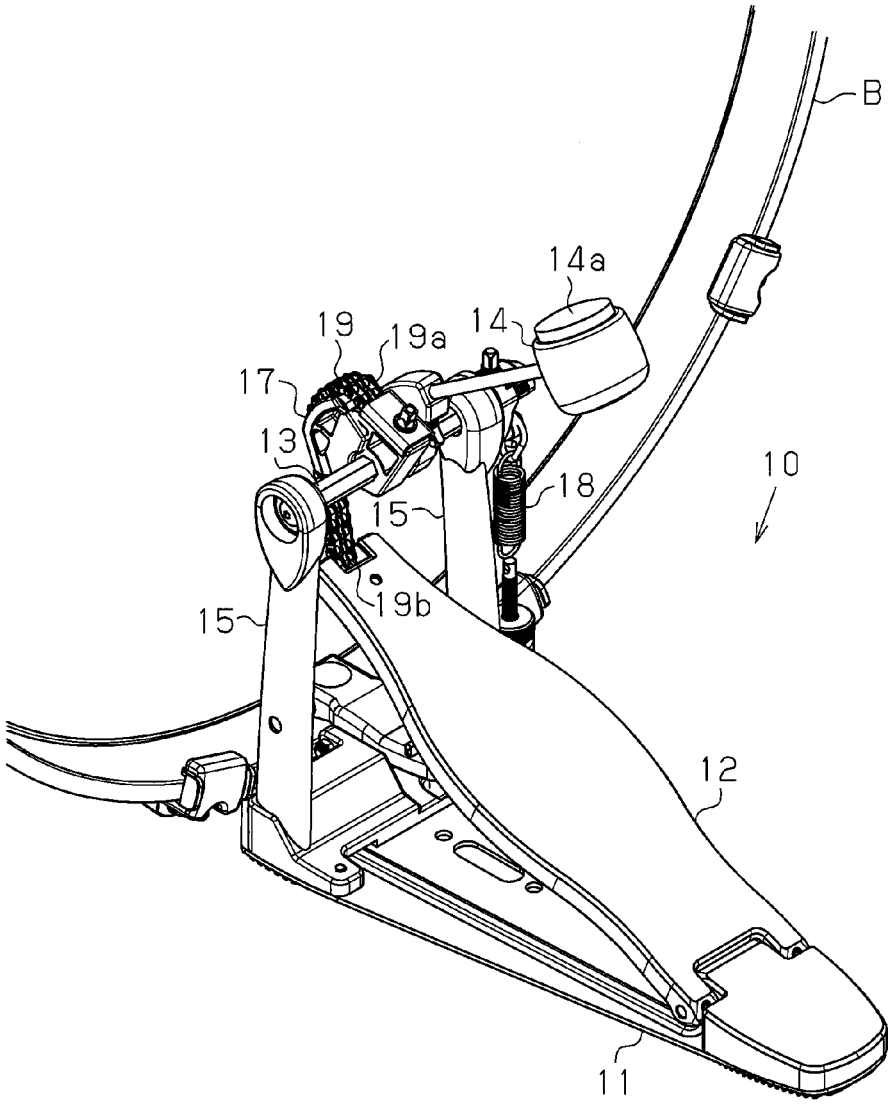
FIG. 1 is a perspective view illustrating a pedal device according to a first embodiment of the present invention connected to a bass drum.

As illustrated in FIG. 1, a pedal device 10 is provided with a base plate 11, a footboard 12, a shaft 13, a beater 14 and the like. To a rear end portion of the base plate 11, the proximal end of the footboard 12 is rotationally connected. On the other hand, on the front end portion of the base plate 11, a pair of supports 15 is provided. On the upper ends of the supports 15, the shaft 13 is rotationally supported through bearings (not shown).

The beater 14 is attached substantially at the center of the shaft 13 together with a cam assembly 17. The pedal device 10 is used in a state in which a hitting surface 14*a* of the beater 14 is arranged toward a batter head of a bass drum B and the base plate 11 is connected to the bass drum B. In the pedal device 10, a tensile coil spring 18 is provided along an outer surface of one of the supports 15. The upper end of the tensile coil spring 18 is connected to an end portion of the shaft 13. The lower end of the tensile coil spring 18 is connected to a base portion of the support 15.

A chain 19 as a connecting member is provided between the supports 15. A first end portion 19*a* of the chain 19 is connected to the cam assembly 17. A second end portion 19*b* of the chain 19 is connected to a free end of the footboard 12. The footboard 12 is elastically supported by the tensile coil spring 18 in a state where its free end is lifted up by the chain 19. The pedal device 10 is configured such that, if a player vertically moves the footboard 12 by foot, the beater 14 reciprocally rotates with the shaft 13.

Figure 2:
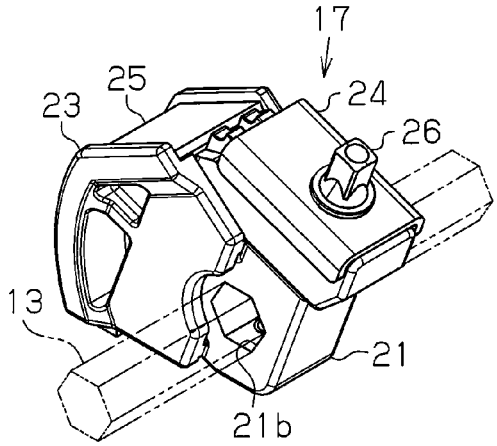
FIG. 2 is a perspective view of a cam assembly constituting the pedal device.
Figure 3:
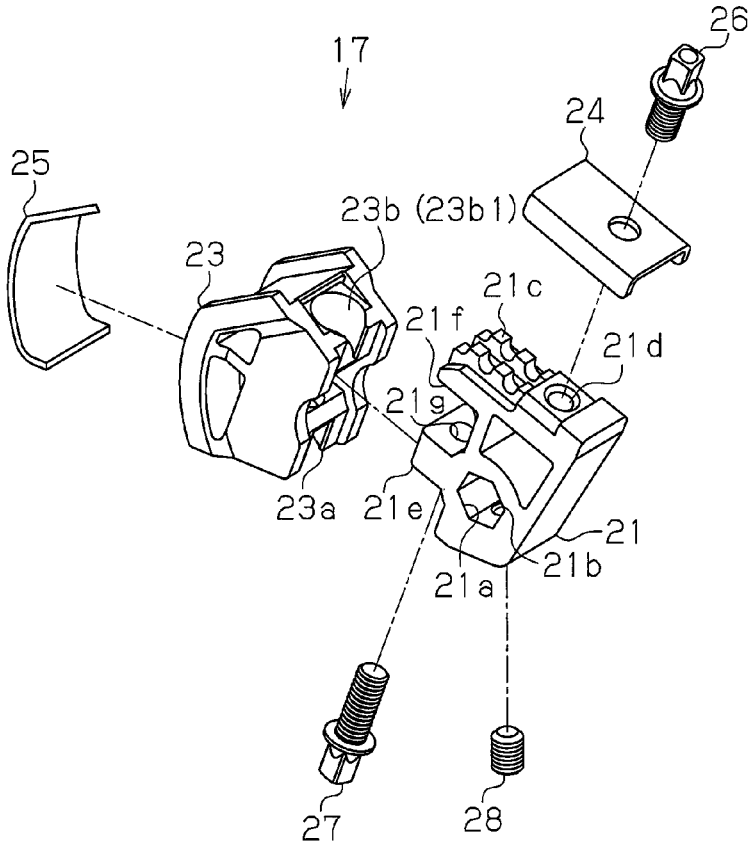
FIG. 3 is an exploded perspective view of the cam assembly.

As illustrated in FIGS. 2 and 3, the cam assembly 17 is provided with a wheel member 21, a cam member 23, a holding plate 24, and a cover 25. The wheel member 21 and the holding plate 24 are made of metal such as an aluminum alloy or the like. The cam member 23 is made of a synthetic plastic such as nylon, polyester, polycarbonate and the like. The cover 25 is made of an elastic member such as felt, rubber and the like. In the first embodiment, the wheel member 21, the cam member 23, and the holding plate 24 are assembled integrally by using two bolts 26 and 27.

The wheel member 21 has a fixing hole 21*a*, through which the shaft 13 is inserted and fixed. The fixing hole 21*a* has a hexagonal cross-section and has the same cross-sectional shape as that of the shaft 13. A first threaded hole 21*b* extending through the fixing hole 21*a* is formed in the lower portion of the wheel member 21. By tightening a screw 28 screwed in the first threaded hole 21*b* and by pressing the tip end of the screw 28 to the shaft 13 in the fixing hole 21*a*, the shaft 13 is fixed to the fixing hole 21*a*.

In an upper end of the wheel member 21, a sprocket portion 21*c*, with which the first end portion 19*a* of the chain 19 is meshed, is formed. Moreover, in an upper end of the wheel member 21, a second threaded hole 21*d* is formed adjacently to the sprocket portion 21*c*. On the upper end of the wheel member 21, the holding plate 24 is arranged to cover the sprocket portion 21*c* and the second threaded hole 21*d*. The holding plate 24 is attached to the upper end of the wheel member 21 by screwing the bolt 26 in the second threaded hole 21*d*. As a result, the first end portion 19*a* of the chain 19 is fixed by the holding plate 24 to prevent removal of the chain 19 from the sprocket portion 21*c*.

On a portion to which the cam member 23 of the wheel member 21 is attached, a rectangular parallelepiped projecting portion 21*e* is provided. The projecting portion 21*e* extends in a direction orthogonal to an axis of the fixing hole 21*a*. Moreover, the projecting portion 21*e* is spaced away from the sprocket portion 21*c* and also extends in parallel with the sprocket portion 21*c*. Thus, a recess 21*f* is formed between the sprocket portion 21*c* and the projecting portion 21*e*. Moreover, at the center of the projecting portion 21*e*, a third threaded hole 21*g* is formed.

Figure 4A:
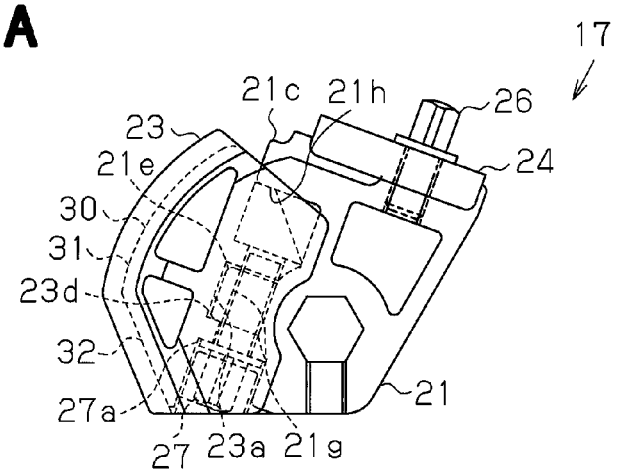
FIG. 4A is a side view of the cam assembly attached to a wheel member with the cam member arranged in a first orientation.
Figure 4B:
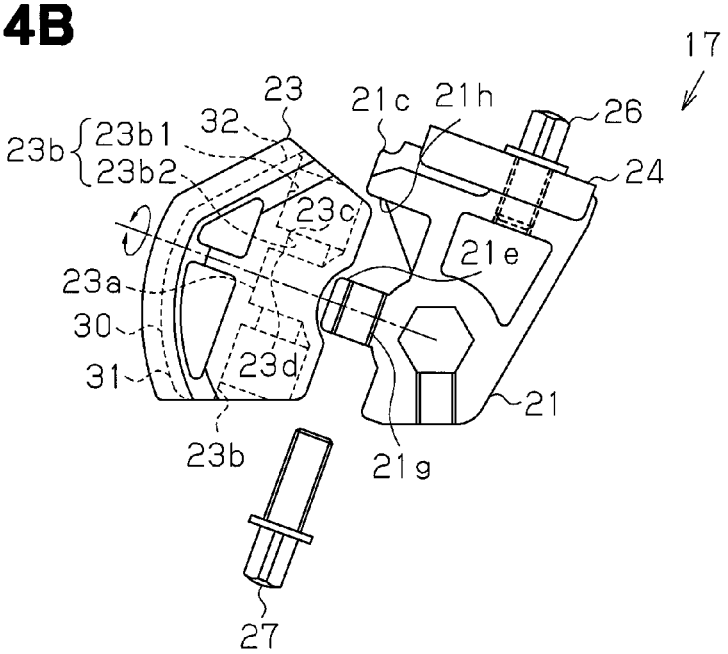
FIG. 4B is a side view illustrating a state in which the cam member has been removed from the wheel member and inverted.
Figure 4C:
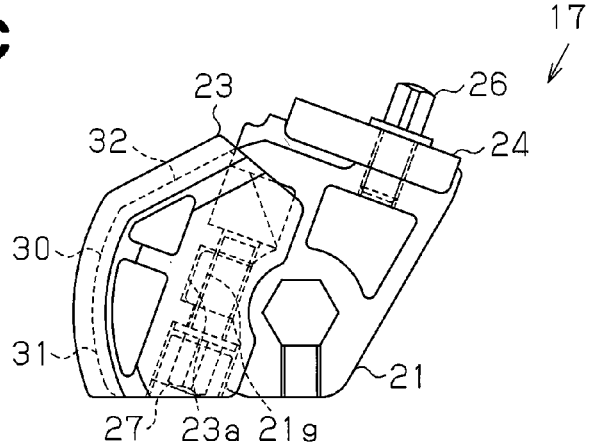
FIG. 4C is a side view of the cam assembly attached to the wheel member with the cam member arranged in a second orientation.

As illustrated in FIGS. 4A to 4C, the cam member 23 is formed to be attachable to the wheel member 21 with the orientation thereof variable with respect to the wheel member 21. That is, the cam member 23 can be arranged in a first orientation illustrated in FIG. 4A. Alternatively, the cam member 23 can be arranged in a second orientation illustrated in FIGS. 4B and 4C, in which the first orientation is vertically inverted. The cam member 23 has a fitting recess 23*a* at a position corresponding to the projecting portion 21*e* of the wheel member 21. In a state where the cam member 23 is attached to the wheel member 21, a part of the cam member 23 is fitted in the recess 21*f* of the wheel member 21, and the projecting portion 21*e* of the wheel member 21 is fitted in the fitting recess 23*a* of the cam member 23.

Moreover, in the cam member 23, a pair of upper and lower through holes 23*b* extending through the fitting recess 23*a* is formed. The through holes 23*b* are composed of a first through hole 23*b*1 and a second through hole 23*b*2 having a diameter smaller than that of the first through hole 23*b*1. The second through hole 23*b*2 has steps 23*c* and 23*d* at the boundaries with the first through hole 23*b*1 and the fitting recess 23*a*, respectively. After the cam member 23 is attached to the wheel member 21, the bolt 27 is inserted through the through hole 23*b* from below the cam member 23 and screwed into the third threaded hole 21*g*. Then, by screwing the bolt 27, the step 23*d* is pressed onto the projecting portion 21*e* by a head portion 27*a* of the bolt 27, and the cam member 23 is pressed onto a back surface 21*h* of the sprocket portion 21*c*. As described above, the cam member 23 is fixed to the wheel member 21.

The cam member 23 has a cam surface 30 on a portion around which the chain 19 is wound. The cam member 23 is a component for converting a vertical motion of the footboard 12 to a rotary motion of the shaft 13 through the chain 19. The cam surface 30 is a portion where the chain 19 pulled downward by the stepping-on operation of the footboard 12 acts on the cam member 23. Thus, the cam shape of the cam surface 30 affects the feeling during the stepping-on operation of the footboard 12. The cam surface 30 has a cam shape which can realize two types of feeling by using the one cam member 23.

As illustrated in FIGS. 5A to 6B, the cam surface 30 is provided with an arcuate first region 31 having an axis C1 of the shaft 13 as the center and a second region 32 having a distance from the axis of the shaft 13 that is shorter than that of the first region 31. In the first region 31, a distance d from the axis C1 of the shaft 13 to the cam surface 30 is constant regardless of the stepped-on amount of the footboard 12. In the second region 32, a distance dx from the axis C1 of the shaft 13 to the cam surface 30 gradually changes in accordance with the stepped-on amount of the footboard 12.

Figure 5A:
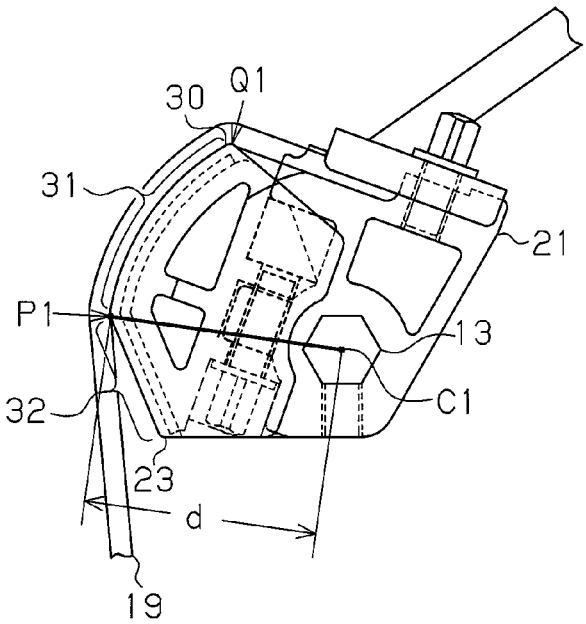
FIGS. 5A and 5B are side views illustrating a point of action where a chain acts on a cam member when the cam member is attached to the wheel member while being arranged to the first orientation.
Figure 5B:
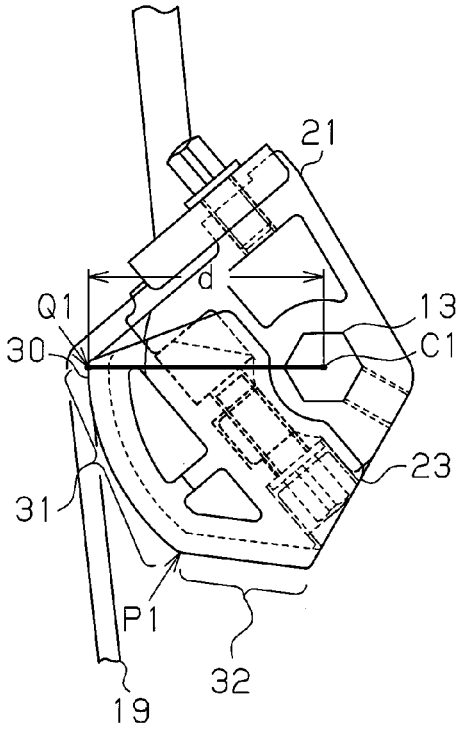

As illustrated in FIGS. 5A and 5B, by attaching the cam member 23 to the wheel member 21 with its orientation arranged in the first orientation, a first cam shape is given to the cam assembly 17. As illustrated in FIG. 5A, a point of action P1, where the chain 19 acts on the cam member 23 at the time when the footboard 12 begins to be stepped on, is in the vicinity of the boundary with the second region 32 in the first region 31. On the other hand, as illustrated in FIG. 5B, a point of action Q1, where the chain 19 acts on the cam member 23 at the time when the footboard 12 is stepped on to the deepest, is in the vicinity of an end portion on the opposite side of the second region 32 in the first region 31. As described above, if the cam member 23 is arranged in the first orientation and attached to the wheel member 21, the chain 19 acts on the cam member 23 between the points of action P1-Q1, where the distance d from the axis C1 of the shaft 13 to the cam surface 30 is constant. In this case, a change amount of the rotation angle of the shaft 13 with respect to the stepped-on amount of the footboard 12 is constant. Thus, a rotation speed of the shaft 13 with respect to the stepped-on speed of the footboard 12 is also constant.

Figure 6A:
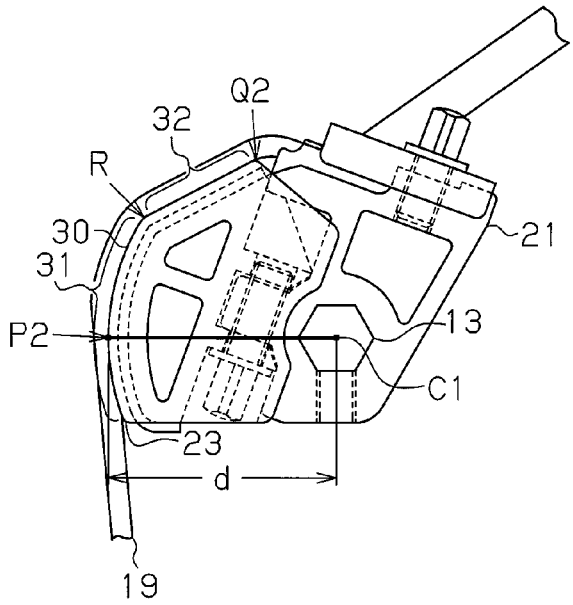
FIGS. 6A and 6B are side views illustrating a point of action where a chain acts on a cam member when the cam member is arranged in the second orientation and attached to the wheel member.
Figure 6B:
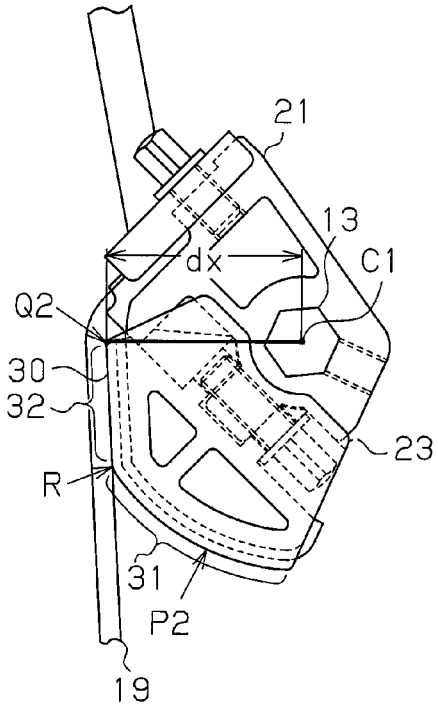

As illustrated in FIGS. 6A and 6B, by attaching the cam member 23 to the wheel member 21 with its orientation arranged in the second orientation, a second cam shape, which is different from the first cam shape, is given to the cam assembly 17. As illustrated in FIG. 6A, a point of action P2, where the chain 19 acts on the cam member 23 at the time when the footboard 12 begins to be stepped on, is in the vicinity of the center of the first region 31. On the other hand, as illustrated in FIG. 6B, a point of action Q2, where the chain 19 acts on the cam member 23 at the time when the footboard 12 is stepped on to the deepest, is in the vicinity of an end portion of the second region 32. As described above, if the cam member 23 is arranged in the second orientation and attached to the wheel member 21, the chain 19 acts on the cam member 23 to reach the point of action Q2 from the point of action P2 via a boundary point R between the first and second regions 31 and 32.

In this case, the distance from the axis C1 of the shaft 13 to the cam surface 30 changes while going from the point of action P2 to the point of action Q2 via the boundary point R. Specifically, between the point of action P2 and the boundary point R, the distance d from the axis C1 of the shaft 13 to the cam surface 30 is constant. Thus, a change amount of the rotation angle of the shaft 13 with respect to the stepped-on amount of the footboard 12 is also constant, and the rotation speed of the shaft 13 with respect to the stepped-on speed of the footboard 12 is also constant. On the other hand, between the boundary point R and the point of action Q2, the distance dx from the axis C1 of the shaft 13 to the cam surface 30 gradually becomes smaller while going from the boundary point R to the point of action Q2. Thus, the change amount of the rotation angle of the shaft 13 with respect to the stepped-on amount of the footboard 12 gradually becomes larger, and the rotation speed of the shaft 13 with respect to the stepped-on speed of the footboard 12 is also raised gradually.

Subsequently, operation of the pedal device 10 will be described with reference to FIGS. 4A to 6B.

First, a case in which the cam member 23 is arranged in the first orientation illustrated in FIG. 4A and attached to the wheel member 21 will be described.

As illustrated in FIG. 4A, the cam member 23 is attached to the wheel member 21 with the first region 31 of the cam surface 30 directed upward and the second region 32 directed downward. Then, the bolt 27 is screwed into the third threaded hole 21*g* from below, and the cam member 23 is fixed to the wheel member 21. By arranging the cam member 23 in the first orientation and attached to the wheel member 21, the first cam shape is given to the cam assembly 17.

In this case, as illustrated in FIGS. 5A and 5B, if the chain 19 is pulled downward by the stepping-on operation of the footboard 12, the chain 19 acts on the cam member 23 between the points of action P1 and Q1. That is, the chain 19 keeps on acting on the cam member 23 within a range of the first region 31. In the first region 31, the distance d from the axis C1 of the shaft 13 to the cam surface 30 is constant. Therefore, a change amount of a rotation angle of the shaft 13 with respect to the stepped-on amount of the footboard 12 is constant. Thus, the rotation speed of the shaft 13 with respect to the stepped-on speed of the footboard 12 is also constant. Therefore, the beater 14 hits the batter head of the bass drum B while rotating at a constant speed together with the shaft 13.

Subsequently, a case in which the cam member 23 is arranged in the second orientation illustrated in FIGS. 4B and 4C and attached to the wheel member 21 will be described.

As illustrated in FIG. 4B, the cam member 23 is removed from the wheel member 21 and is vertically inverted and attached to the wheel member 21. That is, the cam member 23 is attached to the wheel member 21 with the second region 32 of the cam surface 30 directed upward and the first region 31 directed downward. Then, the bolt 27 is screwed into the third threaded hole 21*g* from below, and the cam member 23 is fixed to the wheel member 21. By arranging the cam member 23 in the second orientation and attached to the wheel member 21, the second cam shape is given to the cam assembly 17.

In this case, if the chain 19 is pulled downward by the stepping-on operation of the footboard 12, as illustrated in FIG. 6A, the chain 19 first acts on the cam member 23 between the point of action P2 and the boundary point R. That is, the chain 19 acts on the cam member 23 within the first region 31 where the distance d from the axis C1 of the shaft 13 to the cam surface 30 is constant. If the footboard 12 is stepped on deeper and the chain 19 is further pulled downward, as illustrated in FIG. 6B, the point of action of the chain 19 and the cam member 23 moves to the point of action Q2 via the boundary point R. That is, the chain 19 begins to act on the cam member 23 within the second region 32. In the second region 32, the distance dx from the axis C1 of the shaft 13 to the cam surface 30 gradually becomes smaller as it comes closer to the point of action Q2. Thus, the change amount of the rotation angle of the shaft 13 with respect to the stepped-on amount of the footboard 12 gradually becomes larger. Thus, the rotation speed of the shaft 13 with respect to the stepped-on speed of the footboard 12 is also raised. Therefore, the beater 14 hits the batter head of the bass drum B while rotating in an accelerated manner together with the shaft 13.

As described above, only by changing the orientation of the cam member 23 and attaching it to the wheel member 21, two types of the cam shapes can be given to the cam assembly 17, and the cam shape can be switched between the two types. As a result, two types of feeling during the stepping-on operation can be realized with a simple configuration, and the feeling can be easily switched between the two types by using the one cam member 23. Moreover, since the cam member 23, which is an existing component constituting the pedal device 10, is used, no labor is required for storage of the component and no problem such as loss of a component and or the like occurs.

Therefore, according to the first embodiment, the following advantages are obtained.

(1) By arranging the cam member 23 in the first orientation and attaching it to the wheel member 21, the first cam shape is given to the cam assembly 17. Moreover, by arranging the cam member 23 in the second orientation and attaching it to the wheel member 21, the second cam shape, which is different from the first cam shape, is given to the cam assembly 17. That is, only by changing the orientation of the cam member 23 and attaching it to the wheel member 21, the two types of the cam shapes can be given to the cam assembly 17, and the cam member can be switched between the two types. Thus, two types of feeling during the stepping-on operation can be realized with a simple configuration and the feeling can be easily switched between the two types by using the one cam member 23. Moreover, since an existing component constituting the pedal device 10 is used, no labor is required for storage of the component and no problem would occur such as loss of the component or the like.

(2) To switch the feeling between the two types during the steeping-on operation, the player removes the cam member 23 from the wheel member 21, vertically inverts it and then, attaches it to the wheel member 21. In this case, the feeling can be switched between the two types by a simple operation of vertically inverting the cam member 23.

(3) The cam surface 30 is provided with the arcuate first region 31, which has the axis C1 of the shaft 13 as the center, and the second region 32, which has a distance dx from the axis C1 of the shaft 13 that is smaller than that of the first region 31. According to this configuration, the vertical positions of the first region 31 and the second region 32 can be inverted by vertically inverting the cam member 23. As a result, if the cam member 23 is attached to the wheel member 21 so that the rotation of the shaft 13 receives the action by the first region 31 of the cam surface 30, the rotation speed of the shaft 13 with respect to the stepping-on speed of the footboard 12 can be kept constant. On the other hand, if the cam member 23 is attached to the wheel member 21 so that the rotation of the shaft 13 receives the action by the second region 32 of the cam surface 30, the rotation speed of the shaft 13 with respect to the stepping-on speed of the footboard 12 can be made higher than that in the case of receiving the action by the first region 31.

(4) In the second region 32, the distance dx from the axis C1 of the shaft 13 to the cam surface 30 gradually changes in accordance with the stepped-on amount of the footboard 12. According to this configuration, when the rotation of the shaft 13 receives the action by the second region 32 of the cam surface 30, the distance dx between the point of action Q2, where the chain 19 acts on the cam surface 30, and the axis C1 of the shaft 13 can be gradually changed in accordance with the stepped-on amount of the footboard 12. As a result, the rotation speed of the shaft 13 with respect to the stepped-on speed of the footboard 12 can be smoothly changed. Thus, it is possible to make a change between the two types of the feeling during the stepped-on operation smoothly.

(5) On a portion of the wheel member 21 to which the cam member 23 is attached, the projecting portion 21*e*, which has a rectangular parallelepiped shape, is provided. The cam member 23 has the fitting recess 23*a* at a position corresponding to the projecting portion 21*e* of the wheel member 21. In the state where the cam member 23 is attached to the wheel member 21, the projecting portion 21*e* of the wheel member 21 is fitted in the fitting recess 23*a* of the cam member 23. According to this configuration, the cam member 23 can be easily attached to a correct position of the wheel member 21.

(6) The third threaded hole 21*g* is formed at the center of the projecting portion 21*e*. The upper and lower through holes 23*b*, which extend through the fitting recess 23*a*, are formed in the cam member 23. The bolt 27 is inserted through the through holes 23*b* from below the cam member 23 and screwed into the third threaded hole 21*g*. As a result, the step 23*d* is pressed onto the projecting portion 21*e* by the head portion 27*a* of the bolt 27, and the cam member 23 is pressed onto the back surface 21*h* of the sprocket portion 21*c*. As described above, the cam member 23 is fixed to the wheel member 21. Thus, the cam member 23 is prevented from coming off during the stepping-on operation of the pedal device 10.

(7) The cam member 23 is formed of a synthetic plastic such as nylon, polyester, polycarbonate and the like. According to this configuration, the weight of the entire cam assembly 17 is reduced. As a result, a stepping-on force on the footboard 12 required for rotation of the cam assembly 17 is reduced, and thus, the stepping-on operation on the footboard 12 is made lighter.

Second Embodiment

A second embodiment of the present invention will be described below with reference to FIGS. 7 to 9C. Detailed description will be omitted for portions in the second embodiment similar to those in the first embodiment.

Figure 7:
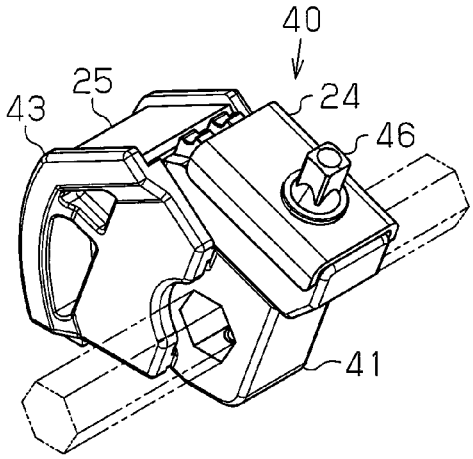
FIG. 7 is a perspective view of a cam assembly constituting a pedal device according to a second embodiment of the present invention.

As illustrated in FIG. 7, a cam assembly 40 is provided with a wheel member 41, a cam member 43, a holding plate 24, and a cover 25. In the second embodiment, the wheel member 41, the cam member 43, and the holding plate 24 are integrally assembled by using only one bolt 46.

Figure 8A:
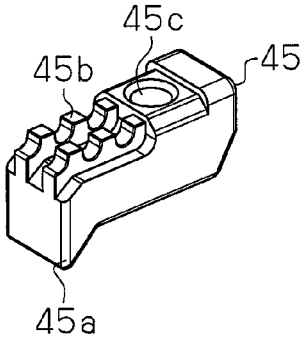
FIG. 8A is a perspective view of a chain wheel.
Figure 8C:
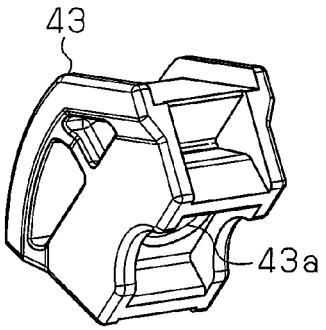
FIG. 8C is a perspective view of the cam member.
Figure 8B:
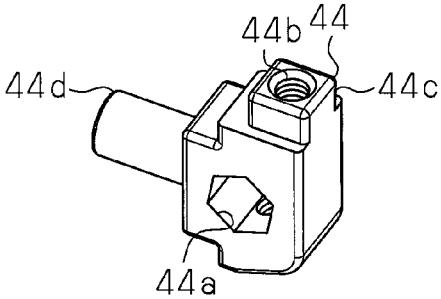
FIG. 8B is a perspective view of a base wheel.

As illustrated in FIGS. 8A and 8B, the wheel member 41 is provided with a base wheel 44 fixed to the shaft 13 and a chain wheel 45 as a stopper, which is a component separate from the base wheel 44. The chain wheel 45 is configured to be removable from the base wheel 44. The base wheel 44 has a fixing hole 44*a*, through which the shaft 13 is inserted and to which it is fixed. A projection 44*c* having a second threaded hole 44*b* is formed in an upper end of the base wheel 44. Moreover, a projecting portion 44*d* is provided on a portion to which the cam member 43 of the base wheel 44 is attached. The projecting portion 44*d* has a columnar shape and extends in a direction orthogonal to the axis of the fixing hole 44*a*.

Figure 9A:
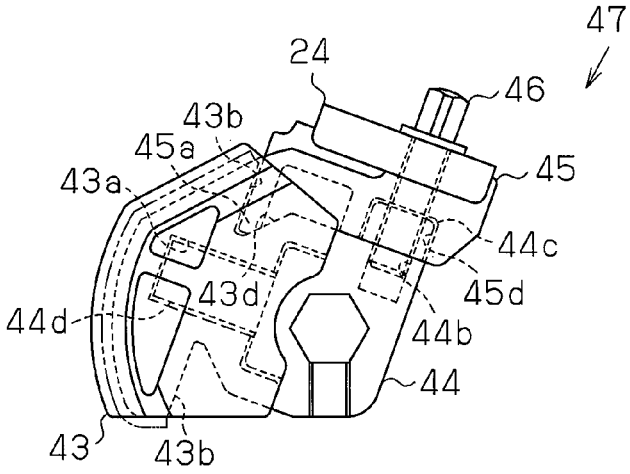
FIG. 9A is a side view of the cam assembly attached to the wheel base with the cam member arranged in the first orientation.
Figure 9B:
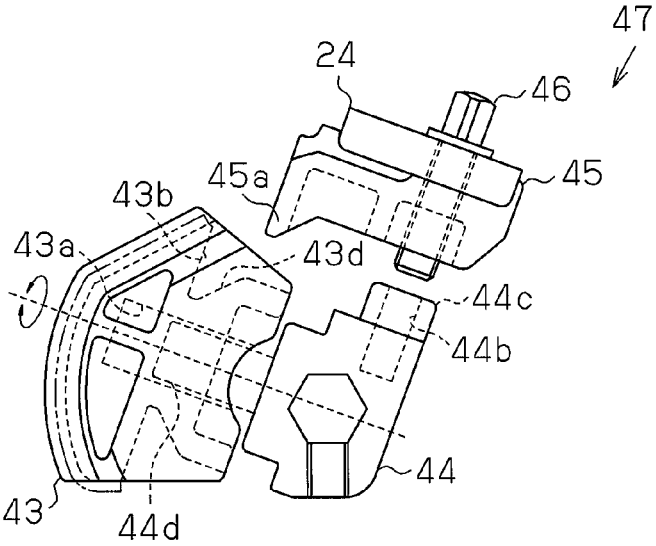
FIG. 9B is a side view illustrating a state in which the cam member has been removed from the wheel base and inverted.
Figure 9C:
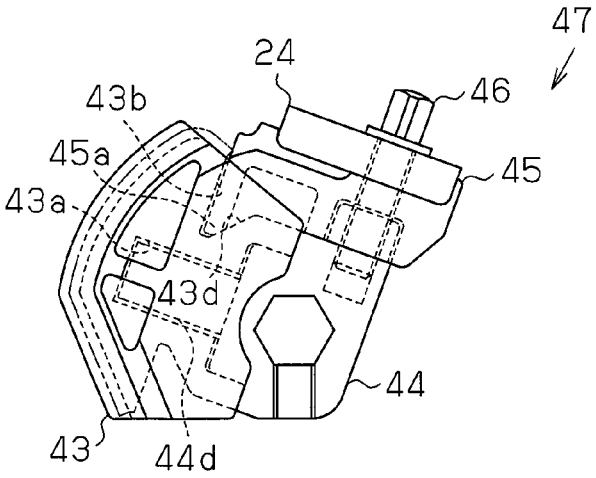
FIG. 9C is a side view of the cam assembly attached to the wheel base with the cam member arranged in the second orientation.

The chain wheel 45 has a substantially rectangular parallelepiped shape as a whole and has a front end portion 45*a* projecting downward. A sprocket portion 45*b*, with which a first end portion 19*a* of the chain 19 is to be meshed, is formed on the upper surface of the chain wheel 45. Moreover, an insertion hole 45*c* is formed adjacently to the sprocket portion 45*b* in the upper surface of the chain wheel 45. As illustrated in FIG. 9A, a recess 45*d* having substantially the same shape as that of the projection 44*c* is formed in the lower surface of the chain wheel 45. The chain wheel 45 is attached to the upper surface of the base wheel 44 by fitting the projection 44*c* in the recess 45*d*.

The holding plate 24 is attached to the base wheel 44 together with the chain wheel 45 by screwing the bolt 46 into the second threaded hole 44*b*. As a result, the first end portion 19*a* of the chain 19 is fixed by the holding plate 24 to prevent removal of the chain 19 from the sprocket portion 45*b*, and moreover, the chain wheel 45 is fixed to the upper surface of the base wheel 44.

As illustrated in FIGS. 8 and 9A to 9C, the cam member 43 is formed to be attachable to the base wheel 44 with the orientation thereof changed with respect to the base wheel 44, similarly to the first embodiment. That is, the cam member 43 is attached to the base wheel 44 while being arranged in a first orientation illustrated in FIG. 9A. Alternatively, the cam member 43 is attached to the base wheel 44 with its orientation arranged in a second orientation illustrated in FIGS. 9B and 9C obtained by vertically inverting the first orientation.

The cam member 43 has a fitting recess 43*a* at a position corresponding to the projecting portion 44*d* of the base wheel 44. The fitting recess 43*a* has a circular section and has the same cross-sectional shape as that of the projecting portion 44*d*. Moreover, a locking portion by which the front end portion 45*a* of the chain wheel 45 is locked is provided on the cam member 43. The locking portion is formed of a pair of upper and lower locking holes 43*b* and is provided at a position corresponding to the front end portion 45*a* of the chain wheel 45. The locking hole 43*b* has substantially the same shape as that of the front end portion 45*a* of the chain wheel 45.

In a state where the cam member 43 is attached to the base wheel 44, the projecting portion 44*d* of the base wheel 44 is fitted in the fitting recess 43*a* of the cam member 43, and moreover, the front end portion 45*a* of the chain wheel 45 is fitted in the locking hole 43*b* of the cam member 43. In this state, by screwing the bolt 46 into the second threaded hole 44*b*, the front end portion 45*a* of the chain wheel 45 is pressed onto a wall surface 43*d* of the locking hole 43*b*. As described above, the cam member 43 is fixed to the base wheel 44. On the other hand, by removing the bolt 46 from the second threaded hole 44*b*, the chain wheel 45 can be removed from the base wheel 44 together with the holding plate 24, and the cam member 43 can be removed from the base wheel 44.

Therefore, according to the second embodiment, the following advantages are obtained.

(8) The projecting portion 44*d* having a columnar shape is provided on a portion to which the cam member 43 of the base wheel 44 is attached. The cam member 43 has the fitting recess 43*a* at a position corresponding to the projecting portion 44*d* of the base wheel 44. The fitting recess 43*a* has a circular section and has the same cross-sectional shape as that of the projecting portion 44*d*. According to this configuration, when the cam member 43 is vertically inverted, it can be rotated around the axis of the projecting portion 44*d* while the cam member 43 is attached to the base wheel 44. In this case, there is no need to remove the cam member 43 from the base wheel 44. Thus, the cam member 43 can be easily inverted vertically.

(9) In a state where the cam member 43 is attached to the base wheel 44, the projecting portion 44*d* of the base wheel 44 is fitted in the fitting recess 43*a* of the cam member 43 and moreover, the front end portion 45*a* of the chain wheel 45 is fitted in the locking hole 43*b* of the cam member 43. By screwing the bolt 46 into the second threaded hole 44*b* in this state, the front end portion 45*a* of the chain wheel 45 is pressed onto the wall surface 43*d* of the locking hole 43*b*. As described above, the cam member 43 is fixed to the base wheel 44. As a result, the cam member 43 is further reliably prevented from coming off during the stepping-on operation of the pedal device 10.

Moreover, according to this configuration, the base wheel 44 and the chain wheel 45 constituting the wheel member 41 and the cam member 43 can be integrally assembled by using only one bolt 46. Thus, as compared with the first embodiment in which the wheel member 21 and the cam member 23 are assembled by using the two bolts 26 and 27, the number of bolts can be reduced. Therefore, the number of assembling processes of the cam assembly 40 is also reduced.

The first and second embodiments may be modified as follows.

Figure 10:
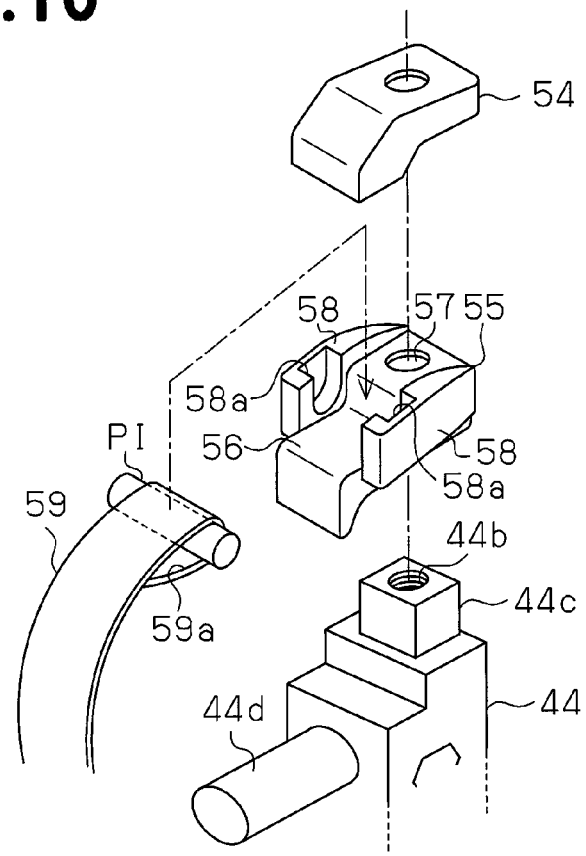
FIG. 10 is a perspective view of a belt wheel according to a modification of the present invention.

In the second embodiment, in addition to the chain wheel 45 illustrated in FIG. 8A, a belt wheel 55 illustrated in FIG. 10 may be provided. As illustrated in FIG. 10, the belt wheel 55 does not have the sprocket portion 45*b* unlike the chain wheel 45 illustrated in FIG. 8A. Instead of the sprocket portion 45*b*, a flat portion 56, an insertion hole 57, and a pair of holding portions 58 are formed on the upper surface of the belt wheel 55. A vertical groove 58*a* opened inside is formed in each of the holding portions 58. A strap belt 59 is made of a band-shaped material and is formed by sewing opposite ends of the strap belt 59 into a loop shape, respectively. An insertion hole 59*a* through which a pin PI is inserted is formed at each of the opposite ends of the strap belt 59.

The strap belt 59 is held by the belt wheel 55 by inserting the pin PI into the insertion hole 59*a* and then, fitting each end portion of the pin PI in the vertical groove 58*a*. Subsequently, by fitting the projection 44*c* in a recess (not shown) of the belt wheel 55, the belt wheel 55 is attached to the upper surface of the base wheel 44. Then, by arranging the holding plate 54 on the belt wheel 55 and by tightening a bolt (not shown) to the second threaded hole 44*b* through the insertion hole 57, the holding plate 54 is attached to the base wheel 44 together with the belt wheel 55. As a result, the end portion of the strap belt 59 is fixed by the holding plate 54 to prevent removal of the belt 59 from the belt wheel 55, and the belt wheel 55 is fixed to the upper surface of the base wheel 44.

According to this configuration, the player selects the chain wheel 45 when using the chain 19 and selects the belt wheel 55 when using the strap belt 59 instead of the chain 19 and can attach either one to the base wheel 44. By configuring as above, one unit of the pedal device 10 can be used both as a chain-type pedal device and a belt-type pedal device.

Figure 11:
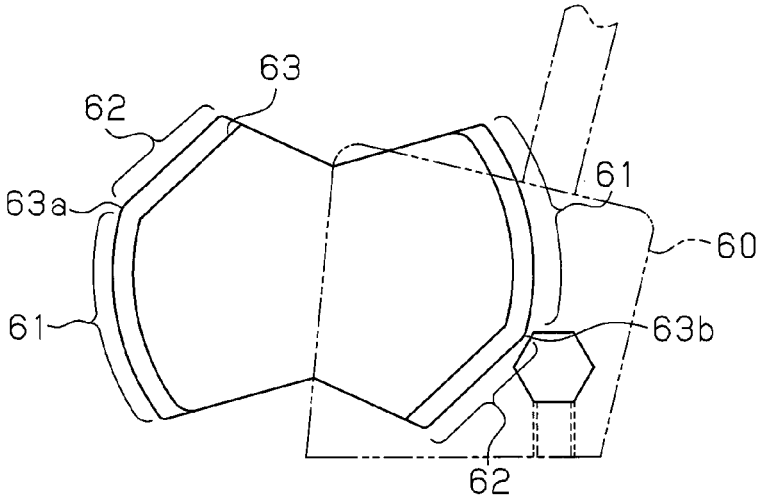
FIG. 11 is a side view of the cam member according to a modification of the present invention.

In the first and second embodiments, the cam members 23 and 43 are vertically inverted and attached to the wheel members 21 and 41, but as illustrated in FIG. 11, it may be changed such that the cam member 63 is inverted longitudinally and attached to the wheel member 60. According to the cam member 63 illustrated in FIG. 11, the first region 61 and the second region 62 are vertically inverted and provided by one cam surface 63*a* and a cam surface 63*b* on the opposite side for the cam member 63. In this state, it is only necessary that the wheel member 60 is configured such that the cam member 63 can be sandwiched and fixed from the lateral orientation.

In the first and second embodiments, a positional relationship between i) the projecting portions 21*e* and 44*d* provided on the wheel member 21 and the base wheel 44 and ii) the fitting recesses 23*a* and 43*a* provided in the cam members 23 and 43 may be reversed. That is, the fitting recess may be provided in the wheel member 21 and the base wheel 44, and the projecting portion may be provided on the cam members 23 and 43.

In the first and second embodiments, the cam member 23 may be formed of a material having rigidity other than a synthetic plastic. Specifically, the material includes metal, ceramics, rubber, wood and the like.

In the first embodiment, the cross-sectional shape of the projecting portion 21*e* provided on the wheel member 21 may be changed to an arbitrary polygonal shape other than a rectangular parallelepiped.

In the first and second embodiments, the present invention is applied to the pedal device 10 for a bass drum but may be applied to a pedal device for a high hat, a pedal device for a twin pedal and the like.

The invention claimed is:

1. A pedal device for a musical instrument, wherein the musical instrument is played by performing a stepping-on operation on a footboard, the device comprising a base, a shaft supported rotationally with respect to the base, a cam fixed to the shaft, and a connecting member for connecting the footboard and the cam, wherein the device is configured such that, when the footboard is stepped on, the cam and the shaft are rotated by the connecting member, and wherein the cam is composed of a cam assembly provided with a wheel member fixed to the shaft and a cam member removably attached to the wheel member and having a cam surface, by attaching the cam member to the wheel member with the orientation of the cam member set in a first orientation, a first cam shape is given to the cam assembly, and by attaching the cam member to the wheel member with the orientation of the cam member set in a second orientation, which is different from the first orientation, a second cam shape, which is different from the first cam shape, is given to the cam assembly.

2. The pedal device for a musical instrument according to claim 1, wherein the second orientation is an orientation obtained by vertically inverting the first orientation.

3. The pedal device for a musical instrument according to claim 2, wherein the cam surface includes an arcuate first region having an axis of the shaft as the center and a second region having a distance from the axis of the shaft that is smaller than that of the first region.

4. The pedal device for a musical instrument according to claim 3, wherein, in the second region, a distance from the axis of the shaft to the cam surface is set to gradually change in accordance with a stepped-on amount of the footboard.

5. The pedal device for a musical instrument according to claim 1, wherein a projecting portion is provided on the wheel member, a fitting recess to be fitted with the projection portion is provided in the cam member, and the cam member is attached to the wheel member by fitting the projecting portion in the fitting recess.

6. The pedal device for a musical instrument according to claim 5, wherein a threaded hole is formed in the projecting portion, a through hole is formed in the cam member, and by screwing a bolt inserted through the through hole with the threaded hole, the cam member is fixed to the wheel member.

7. The pedal device for a musical instrument according to claim 6, wherein the projecting portion and the fitting recess both have a circular cross-section.

8. The pedal device for a musical instrument according to claim 5, wherein a locking portion by which the wheel member is locked is provided on the cam member.

9. The pedal device for a musical instrument according to claim 1, wherein the cam member is made of a plastic.

10. The pedal device for a musical instrument according to claim 1, wherein the wheel member includes a base wheel fixed to the shaft and a stopper that is removably attached to the base wheel and to which the connecting member is connected, and the stopper selected in accordance with a type of the connecting member is attached to the base wheel.

* * * * *